US009973852B1

(12) United States Patent
Hesketh et al.

(10) Patent No.: US 9,973,852 B1
(45) Date of Patent: May 15, 2018

(54) DEVICE HAVING UPDATED ACOUSTIC RESPONSE BASED ON HINGE ANGLE

(71) Applicant: Microsoft Technology Licensing, LLC, Redmond, WA (US)

(72) Inventors: John B. Hesketh, Kirkland, WA (US); Adolfo Hernandez Santisteban, Mexico City (MX); Roger Sebastian Sylvan, Seattle, WA (US); Aaron M. Burns, Newcastle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days. days.

(21) Appl. No.: 15/379,351

(22) Filed: Dec. 14, 2016

(51) Int. Cl.

| | |
|---|---|
| ***H04R 1/40*** | (2006.01) |
| ***H04R 3/04*** | (2006.01) |
| ***H04R 3/12*** | (2006.01) |
| ***H04R 29/00*** | (2006.01) |

(52) U.S. Cl.
CPC ..... *H04R 3/04* (2013.01); *H04R 3/12* (2013.01); *H04R 29/002* (2013.01); *H04R 2430/01* (2013.01); *H04R 2499/11* (2013.01)

(58) Field of Classification Search
CPC ..... H04R 3/04; H04R 3/12; H04R 29/002; H04R 2430/01; H04R 2499/11
USPC ... 381/56, 59, 61, 63, 64, 97, 107, 108, 119, 381/345, 351, 386; 361/679.08, 679.09, 361/679.17; 700/94
See application file for complete search history.

(56) References Cited

U.S. PATENT DOCUMENTS

| | | | |
|---|---|---|---|
| 6,798,654 | B2 | 9/2004 | Chang et al. |
| 7,602,923 | B2 | 10/2009 | Lee et al. |
| 8,135,156 | B2 | 3/2012 | Hu |
| 8,873,763 | B2 | 10/2014 | Tsang |
| 8,996,767 | B2 | 3/2015 | Eaton et al. |
| 9,013,368 | B1 | 4/2015 | Kim |
| 9,179,220 | B2 | 11/2015 | Morris |
| 2006/0083401 | A1 | 4/2006 | Go |
| 2009/0264156 | A1 | 10/2009 | Burghardt et al. |

(Continued)

FOREIGN PATENT DOCUMENTS

| | | | |
|---|---|---|---|
| WO | 2005006715 | A2 | 1/2005 |

OTHER PUBLICATIONS

Onishi, et al., i"The Acoustical design of Mobile phones", In Proceedings of 20th International Congress on Acoustics, Aug. 23, 2010, pp. 1-8.

*Primary Examiner* — Paul S Kim
*Assistant Examiner* — Friedrich W Fahnert
(74) *Attorney, Agent, or Firm* — Wade IP Law LLC

(57) ABSTRACT

Techniques are described herein that are capable of providing an updated acoustic response for a device based at least in part on a hinge angle. For instance, an angle of a hinge that is coupled between first and second members of a device may be determined. The angle is defined between first and second surfaces of the respective first and second members. A spectral signal has a frequency spectrum that includes multiple portions. An amplitude of each portion of the frequency spectrum is selectively modified to change an acoustic response of the device to an updated acoustic response based at least in part on the angle of the hinge. The acoustic response of the device is associated with a resonance chamber, which is defined by the first surface, the second surface, and a third surface.

20 Claims, 5 Drawing Sheets

(56) References Cited

U.S. PATENT DOCUMENTS

| | | | | |
|---|---|---|---|---|
| 2012/0176741 | A1* | 7/2012 | Wu | G06F 1/1601<br>361/679.09 |
| 2013/0114840 | A1 | 5/2013 | Shin | |
| 2013/0170124 | A1* | 7/2013 | Pan | H05K 5/0226<br>361/679.08 |
| 2013/0170126 | A1* | 7/2013 | Lee | G06F 1/1654<br>361/679.17 |
| 2017/0325038 | A1* | 11/2017 | Yu | H04R 29/00 |

* cited by examiner

DEVICE HAVING UPDATED ACOUSTIC RESPONSE BASED ON HINGE ANGLE

BACKGROUND

In modern society, people are using devices (e.g., mobile electronic devices) increasingly more in their everyday lives. For instance, people often carry devices with which they can discover information (e.g., using a digital personal assistant), perform work, consume audio and/or video content, and communicate with friends, coworkers, and family members. A conventional device typically has a relatively small speaker that is unable to create high-volume, low-frequency sounds. For instance, the speaker may include a vibrating membrane that is too small to generate low-frequency sounds.

A variety of techniques has been proposed for improving low-frequency response of devices. However, each such technique has its limitations. In one example, a resonance cavity (a.k.a. boom box) is incorporated into a device to amplify low frequencies. However, a trend in the marketplace is for device manufacturers to produce increasingly thinner devices, which may limit the size of resonance cavities incorporated therein. Such a size-constrained resonance cavity may not be able to adequately amplify the low frequencies.

In another example, a device may be placed in a container (e.g., a cup), or a tube (e.g., a toilet paper roll) may be attached to the device, to amplify sounds that are generated by the device. However, such a container or tube traditionally is not acoustically calibrated and therefore typically causes the generation of standing waves. Such standing waves often reduce clarity of the sounds that are generated by the device. For instance, harmonics of lower frequencies may interfere with higher frequencies.

In yet another example, digital signal processing is used to "fake" a desired low frequency. For instance, if a frequency of 250 Hz is desired, 250 Hz may be faked by exciting frequencies that are slightly different from 250 Hz. For example, frequencies of 255 Hz, 260 Hz, and 275 Hz may be excited in addition to or in lieu of 250 Hz to increase an apparent loudness of a 250 Hz signal. However, faking a desired low frequency often results in a signal having reduced clarity. For instance, the signal may sound "muddy."

SUMMARY

Various approaches are described herein for, among other things, providing an updated acoustic response for a device based at least in part on a hinge angle. For instance, the updated acoustic response may amplify low frequencies and/or reduce standing waves, as compared to the acoustic response prior to being updated. A hinge angle is an angle that is formed by a hinge. For example, the hinge angle may have a vertex at an axis about which the hinge rotates. In another example, the hinge angle may have a vertex at a midpoint between first and second pivot points of the hinge.

In an example approach, an angle of a hinge that is coupled between first and second members of a device is determined. The angle of the hinge is defined between a first surface of the first member and a second surface of the second member. A spectral signal has a frequency spectrum that includes multiple portions. For instance, each portion may correspond to a respective subset of the frequencies in the frequency spectrum. Each subset may include one or more of the frequencies. An amplitude of each portion of the frequency spectrum is selectively modified to change an acoustic response of the device to an updated acoustic response based at least in part on the angle of the hinge. The acoustic response of the device is associated with a resonance chamber, which is defined by the first surface, the second surface, and a third surface. For instance, the acoustic response may dictate output audio characteristic(s) of the device for signals that are provided in the resonance chamber. Examples of an output audio characteristic include but are not limited to frequency response and phase response.

As an example, if the angle of the hinge has a first angular value, selectively modifying the amplitude of each portion of the frequency spectrum may cause characteristic(s) of the acoustic response to be changed to have respective first characteristic value(s) in the updated acoustic response. If the angle of the hinge has a second angular value, selectively modifying the amplitude of each portion of the frequency spectrum may cause the characteristic(s) of the acoustic response to be changed to have respective second characteristic value(s) in the updated acoustic response, and so on.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Moreover, it is noted that the invention is not limited to the specific embodiments described in the Detailed Description and/or other sections of this document. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles involved and to enable a person skilled in the relevant art(s) to make and use the disclosed technologies.

Figure 1:
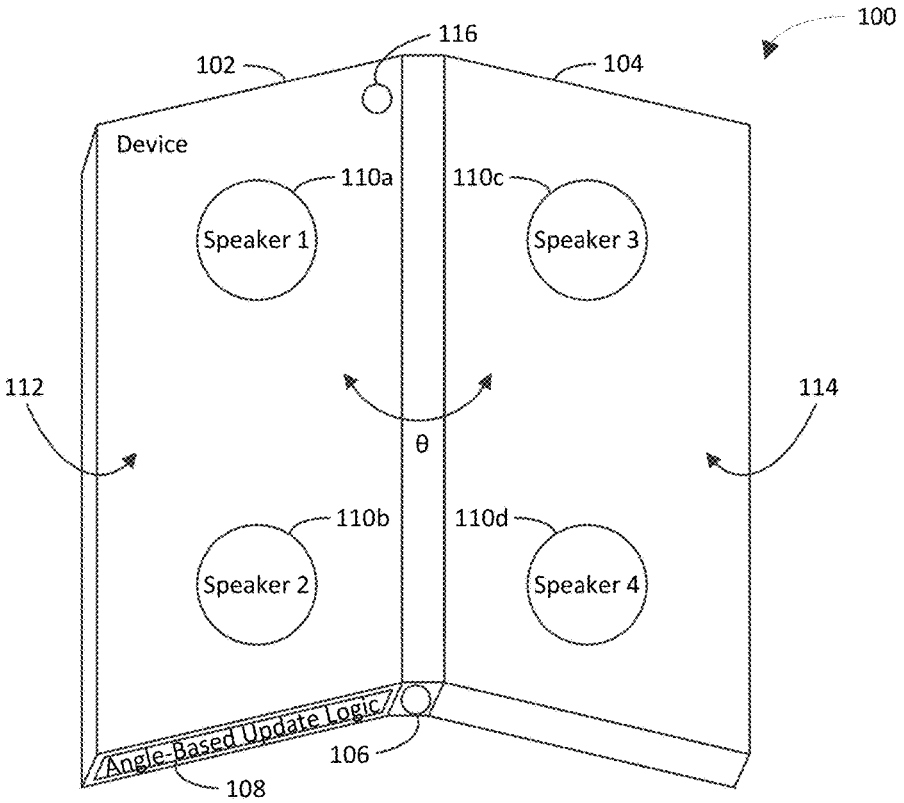
FIGS. 1 and 2 are views of example devices in accordance with embodiments.

The features and advantages of the disclosed technologies will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

I. Introduction

The following detailed description refers to the accompanying drawings that illustrate exemplary embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the relevant art(s) to implement such feature, structure, or characteristic in connection with other embodiments whether or not explicitly described.

II. Example Embodiments

Example embodiments described herein are capable of providing an updated acoustic response for a device based on (e.g., based at least in part on) a hinge angle. For instance, the updated acoustic response may amplify low frequencies and/or reduce standing waves, as compared to the acoustic response prior to being updated. A hinge angle is an angle that is formed by a hinge. For example, the hinge angle may have a vertex at an axis about which the hinge rotates. In another example, the hinge angle may have a vertex at a midpoint between first and second pivot points of the hinge.

Example techniques described herein have a variety of benefits as compared to conventional techniques for generating a spectral signal. For instance, the example techniques may be capable of increasing low-frequency response of a device and/or reducing (e.g., eliminating) standing waves associated with spectral signals that are to be generated by the device. Accordingly, the example techniques may be capable of amplifying low frequencies while reducing standing waves. Such low frequencies may include frequencies in a range of 16 Hz-262 Hz, though the scope of the example embodiments is not limited in this respect.

The example techniques may be capable of performing selective spectral filtering of signals that are to be generated by a device to change an acoustic response of the device. The selective spectral filtering may include selectively modifying amplitudes of respective frequencies in the signals. For example, the acoustic response may be changed to boost low frequencies in the signals (e.g., thereby increasing the low-frequency response of the device). In another example, the acoustic response may be changed to reduce (e.g., eliminate) resonant frequencies in the signals (e.g., thereby reducing amplitudes of respective harmonics of the resonant frequencies).

The example techniques may enable a relatively thin and/or relatively small device to adequately amplify low frequencies. The example techniques may enable a device to amplify low frequencies with substantial clarity as compared to conventional techniques. The example techniques may enable a device having relatively small speaker(s) to create high-volume, low-frequency sounds.

The example techniques may reduce an amount of time and/or resources (e.g., device real estate) that are consumed to generate a signal having boosted low frequencies and/or reduced resonant frequencies. The example techniques may increase user interaction performance. For example, sounds (e.g., frequencies) that are intended to be heard by a user may be boosted and/or clarified. For instance, the sounds that are produced by various speakers of a device may be phase-aligned. In another example, sounds that are not intended to be heard by the user may be reduced (e.g., eliminated).

Figure 2:
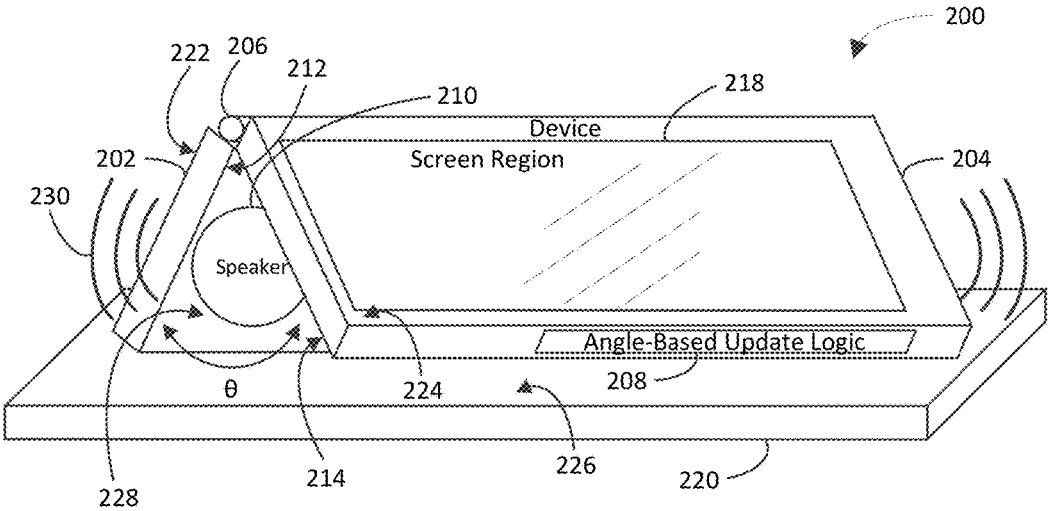

FIGS. 1 and 2 are views of example devices 100 and 200 in accordance with embodiments. Each of the devices 100 and 200 is a processing system that is capable of providing an updated acoustic response based at least in part on a hinge angle. An example of a processing system is a system that includes at least one processor that is capable of manipulating data in accordance with a set of instructions. For instance, a processing system may be a computer, a personal digital assistant, or a cellular telephone.

As shown in FIG. 1, the device 100 includes a hinge 106 that is coupled between a first member 102 and a second member 104. The first member 102 has a first surface 112. The second member 104 has a second surface 114. Rotation of the hinge 106 causes an angle (a.k.a. hinge angle) 0 between the first surface 112 and the second surface 114 to change. For example, rotating the hinge 106 such that the first surface 112 rotates toward the second surface 114 and/or such that the second surface 114 rotates toward the first surface 112 causes the hinge angle to decrease. Rotating the hinge 106 such that the first surface 112 rotates away from the second surface 114 and/or such that the second surface 114 rotates away from the first surface 112 causes the hinge angle to increase.

The device 100 further includes speakers 110*a*-110*d*. The speakers 110*a*-110*d* are configured to produce sound (e.g., spectral signals) in response to signals that are received from angle-based update logic 108, which is discussed in further detail below. The device 100 is shown to include four speakers for illustrative purposes and is not intended to be limiting. It will be recognized that the device 100 may include any suitable number of speakers (e.g., 1, 2, 3, or 4). The speakers 110*a*-110*b* are shown to be positioned at the first surface 112 of the first member 102, and the speakers 110*c*-110*d* are shown to be positioned at the second surface 114 of the second member 104, for non-limiting illustrative purposes. The speakers 110*a*-110*b* may be incorporated into the first member 102 or coupled to the first surface 112 of the first member 102. The speakers 110*c*-110*d* may be incorporated into the second member 104 or coupled to the second surface 114 of the second member 104. Each of the speakers 110*a*-110*b* may be any suitable type of speaker, including but not limited to a film speaker.

The device 110 further includes a microphone 116. The microphone 116 is configured to detect sounds, such as spectral signals that are produced by the speakers 110*a*-110*d*.

The device 100 further includes angle-based update logic 108, which is configured to provide an updated acoustic response for the device 100 based at least in part on the hinge angle θ. Example techniques for providing an updated acoustic response for a device based on a hinge angle are discussed in greater detail below with reference to FIGS. 2-5.

As shown in FIG. 2, the device 200 includes a first member 202, a second member 204, a hinge 206, angle-based update logic 208, and a speaker 210, which are operable in a manner similar to the first member 102, the second member 104, the hinge 206, the angle-based update logic 108, and the speakers 110*a*-110*d* described above with reference to FIG. 1. For instance, the hinge 206 is coupled between the first member 202 and the second member 204.

The first member 202 has opposing first and second surfaces 212 and 222. The second member 204 has opposing first and second surfaces 214 and 224. Rotation of the hinge 206 causes a hinge angle θ between the first surface 212 of the first member 202 and the second surface 214 of the second member 204 to change. The hinge angle θ is shown in FIG. 2 to be less than 180 degrees for illustrative purposes. The device 200 is placed proximate a third surface 226 of an object 220 to create a resonance chamber 228 that is defined by the first surface 212 of the first member 202, the first surface 214 of the second member, and the third surface 226. For example, the device 200 may be placed in contact with the third surface 226 to create the resonance chamber 228. In another example, the device 200 may be placed a spaced distance from the third surface 226 to create the resonance chamber 228. The resonance chamber 228 is configured to amplify sound 230 that is produced by the speaker 210.

The angle-based update logic 208 is configured to determine the hinge angle θ. The angle-based update logic 208 receives a spectral signal, which has a frequency spectrum that includes multiple portions. For instance, each portion may correspond to a respective subset of the frequencies in the frequency spectrum. Each subset may include one or more of the frequencies. The angle-based update logic 208 selectively modifies (e.g., increases or decreases) an amplitude of each portion of the frequency spectrum to change an acoustic response of the device 200 to an updated acoustic response based at least in part on the hinge angle θ. The acoustic response of the device 200 dictates output audio characteristic(s) of the device 200 for sounds (e.g., an acoustic representation of the spectral signal) that are produced by the speaker 210 in the resonance chamber 228. Examples of an output audio characteristic include but are not limited to frequency response and phase response. For instance, the angle-based update logic 208 may cause characteristic(s) of the updated acoustic response to have respective first value(s) in response to (e.g., based on) the hinge angle θ being a first value. The angle-based update logic 208 may cause the characteristic(s) of the updated acoustic response to have respective second value(s) in response to the hinge angle θ being a second value, and so on.

The angle-based update logic 208 may cause the device 200 to enter a low-frequency mode in response to determining that the hinge angle θ is less than a threshold angle. The threshold angle may be any suitable angle, including but not limited to 180 degrees, 120 degrees, or 90 degrees. In the low-frequency mode, the angle-based update logic 208 may cause the amplitudes of respective low frequencies in the spectral signal to be boosted in accordance with the updated acoustic response of the device 200. In the low-frequency mode, the angle-based update logic 208 may cause resonant frequencies and/or harmonics thereof to be de-amplified in accordance with the updated acoustic response of the device 200. Accordingly, the angle-based update logic 208 may reduce (e.g., eliminate) standing waves in accordance with the updated acoustic response of the device 200. The angle-based update logic 208 may cause the device 200 to enter the low-frequency mode further in response to the device 200 being placed proximate the third surface 226.

The second member 204 is shown to include a screen region 218 for non-limiting illustrative purposes. Each of the first and second members 202 and 204 may include any suitable number of screen regions (e.g., 0, 1, 2, 3, or 4). Each screen region may be positioned at (e.g., coincident with) any of the following surfaces: the first surface 212 of the first member 202, the second surface 222 of the first member 202, the first surface 214 of the second member 204, or the second surface 224 of the second member 204. In one example, a first screen region may be positioned at the first surface 212 of the first member 202, and a second screen region may be positioned at the first surface 214 of the second member 204. In another example, a first screen region may be positioned at the second surface 222 of the first member 202, and a second screen region may be positioned at the second surface 224 of the second member 204.

It will be recognized that each of the devices 100 and 200 described above with reference to respective FIGS. 1 and 2 may not include one or more of the components shown therein. Furthermore, each of the devices 100 and 200 may include components in addition to or in lieu of the components shown therein.

Figure 3:
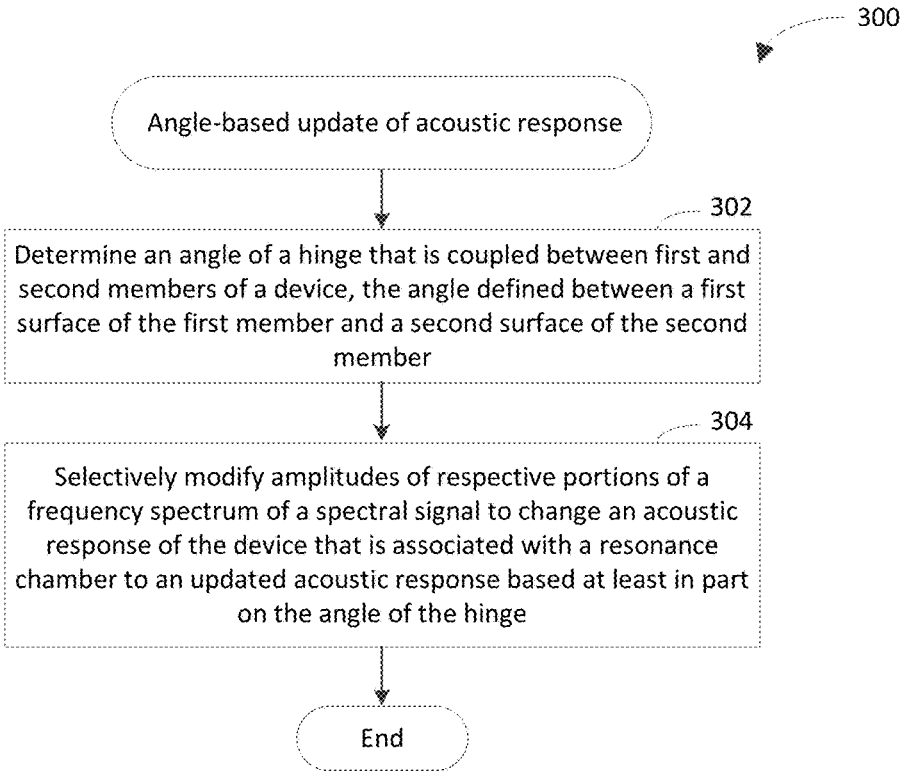
FIGS. 3 and 4 depict flowcharts of example methods for providing an updated acoustic response for a device based at least in part on a hinge angle in accordance with embodiments.
Figure 4:
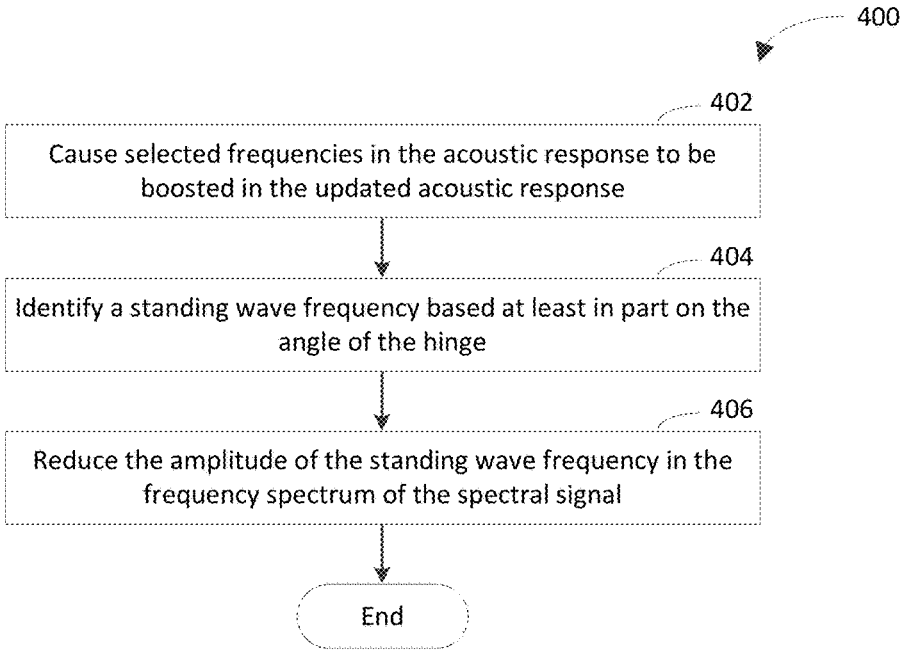
Figure 5:
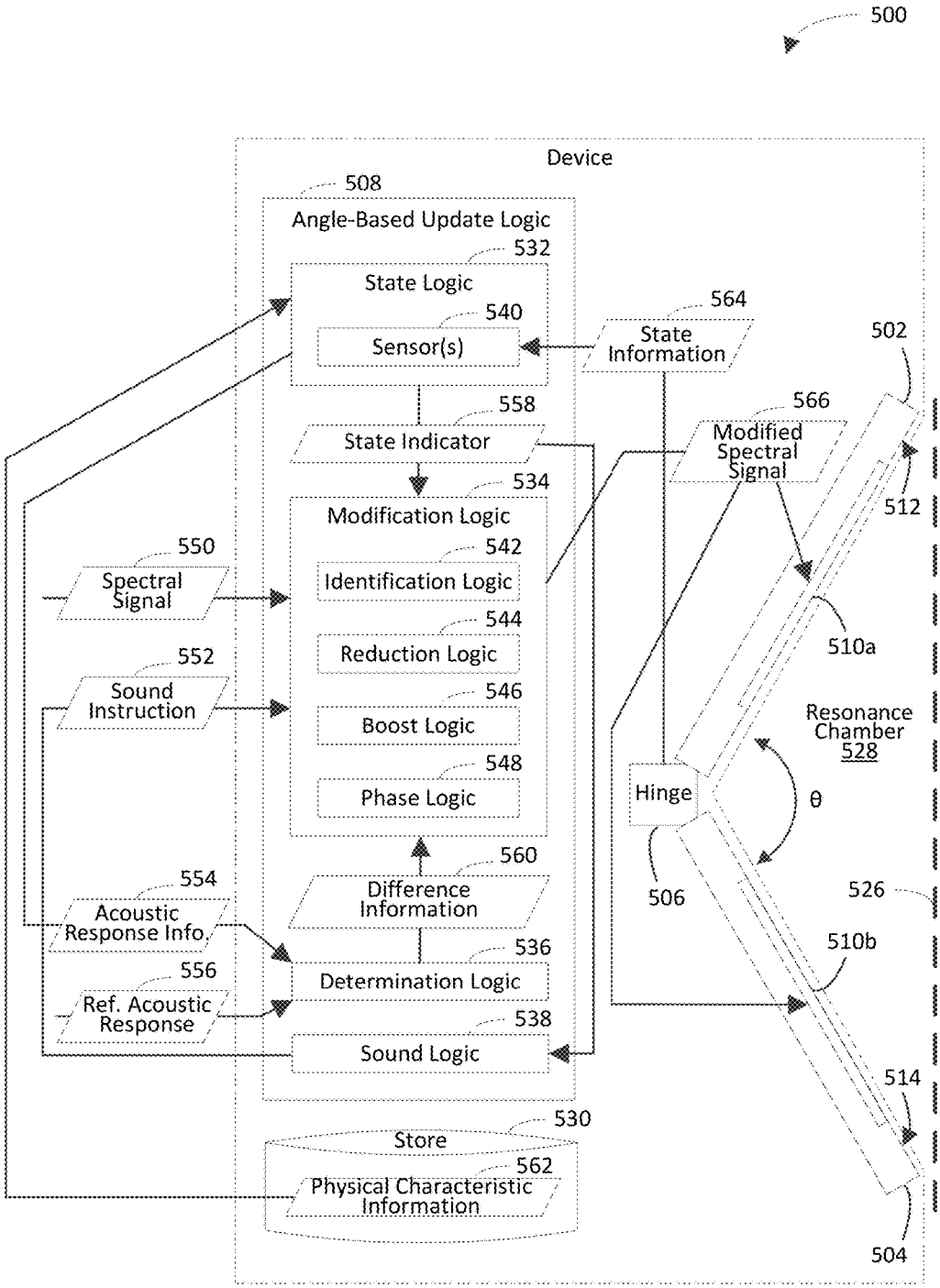
FIG. 5 is a block diagram of an example device in accordance with an embodiment.

FIGS. 3 and 4 depict flowcharts 300 and 400 of example methods for providing an updated acoustic response for a device based at least in part on a hinge angle in accordance with embodiments. Flowcharts 300 and 400 may be performed by the angle-based update logic 108 or 208 shown in respective FIGS. 1-2, for example. For illustrative purposes, the flowcharts 300 and 400 are described with respect to a device 500 shown in FIG. 5. The device 500 includes angle-based update logic 508, which is an example of the angle-based update logic 108 or 208, according to an embodiment. As shown in FIG. 5, the device 500 further includes a first member 502, a second member 504, a hinge 506, and a store 530. The store 530 may be any suitable type of store. One type of store is a database. For instance, the store 530 may be a relational database, an entity-relationship database, an object database, an object relational database, an extensible markup language (XML) database, etc. The first member 502 includes a first speaker(s) 510*a*. The second member 504 includes a second speaker(s) 510*b*. The angle-based update logic 508 includes state logic 532, modification logic 534, determination logic 536, and sound logic 538. The state logic 532 includes sensor(s) 540. The modification logic 534 includes identification logic 542, reduction logic 544, boost logic 546, and phase logic 548. Further structural and operational embodiments will be apparent to persons skilled in the relevant art(s) based on the discussion regarding the flowcharts 300 and 400.

As shown in FIG. 3, the method of the flowchart 300 begins at step 302. In step 302, an angle of a hinge that is coupled between first and second members of a device is determined. The angle of the hinge is defined between a first surface of the first member and a second surface of the second member. In an example implementation, the state logic 532 determines a state of the hinge 506, which is coupled between the first member 502 and the second member 504. For example, the state logic 532 may review state information 564 from the hinge 506, the first member 502, and/or the second member 504 to determine the state of the hinge 506. In accordance with this example, the state information 564 indicates the state of the hinge 506. For instance, the state information 564 may indicate the angle of the hinge 506 (i.e., the hinge angle θ). The hinge angle θ is defined between a first surface 512 of the first member 502 and a second surface 514 of the second member 504.

The state logic 532 is shown in FIG. 5 to include sensor(s) 540 for illustrative purposes. The sensor(s) 540 are configured to sense the state of the hinge 506. For instance, the sensor(s) 540 may sense the state of the hinge 506 based at least in part on the state information 564. Accordingly, the sensor(s) 540 may sense the state information 564, thereby enabling the state logic 532 to determine the state of the hinge 506. The sensor(s) 540 may include any suitable type of sensor(s), including but not limited to angle sensor(s), accelerometer(s), and gyroscope(s). For example, an angle sensor may be coupled to (e.g., incorporated into) the hinge 506 to sense the hinge angle θ. In accordance with this example, the state logic 532 may determine the hinge angle θ in response to the angle sensor sensing the hinge angle θ.

In another example, a first accelerometer or gyroscope may be coupled to the first member 502 to sense first orientation information (e.g., acceleration) of the first member 502, and a second accelerometer or gyroscope may be coupled to the second member 504 to sense second orientation information of the second member 504. Accordingly, the state information 564 may include the first orientation information and the second orientation information. In accordance with this example, the state logic 532 may determine (e.g., infer) the hinge angle θ based at least in part on the first orientation information and the second orientation information. For instance, the state logic 532 may analyze the first orientation information to determine a first angular distance traveled by the first member 502 with respect to a reference angle. The state logic 532 may analyze the second orientation information to determine a second angular distance traveled by the second member 504 with respect to the reference angle. The state logic 532 may combine (e.g., add) the first angular distance and the second angular distance to determine a cumulative angular change between the first member 502 and the second member 504. The state logic 532 may combine (e.g., add) the cumulative angular change and a reference angle to determine the hinge angle θ. For instance, the reference angle may indicate an angle of the hinge 506 before the cumulative angular change occurred.

In accordance with this implementation, the state logic 532 may generate a state indicator 558 in response to determining the state of the hinge 506. The state indicator 558 may indicate (e.g., specify) the state of the hinge 506. For instance, the state indicator 558 may indicate the hinge angle θ.

At step 304, amplitudes of respective portions of a frequency spectrum of a spectral signal are selectively modified to change an acoustic response of the device to an updated acoustic response based at least in part on the angle of the hinge. For example, each of the amplitudes may be selectively modified independently from the other amplitudes. In another example, a shape of the acoustic response may be changed to provide the updated acoustic response. The acoustic response of the device may include a frequency response and/or a phase response of the device. In yet another example, the amplitudes of the respective portions of the frequency spectrum may be selectively modified based at least in part on the angle of the hinge being less than a threshold angle. For instance, the threshold angle may be 180 degrees, 120 degrees, or 90 degrees. In accordance with this example, the amplitudes of the respective portions of the frequency spectrum may be selectively modified if the angle of the hinge is less than the threshold angle, but not if the angle of the hinge is greater than the threshold angle.

The acoustic response of the device is associated with a resonance chamber. The resonance chamber is defined by the first surface of the first member, the second surface of the second member, and a third surface. The third surface may be a surface of any suitable object. For instance, the object may be an inanimate object, such as a tabletop or a floor. Selectively modifying the amplitudes may cause the acoustic response of the device to be changed to the updated acoustic response for spectral signals that are subsequently provided by the device in the resonance chamber. The frequency spectrum of the spectral signal includes multiple frequencies. Each portion of the frequency spectrum may correspond to a respective subset of the frequencies. For instance, each subset may include one or more of the frequencies.

In an example implementation, the modification logic 534 selectively modifies the amplitudes of the respective portions of the frequency spectrum of a spectral signal 550 to change the acoustic response of the device 500 to the updated acoustic response based at least in part on the hinge angle θ. For example, the modification logic 534 may selectively modify the amplitudes in response to receipt of the state indicator 558. In accordance with this example, the modification logic 534 may selectively modify the amplitudes based at least in part on the state indicator 558 indicating the state of the hinge 506 (e.g., the hinge angle θ). The device 500 is associated with a resonance chamber 528. The resonance chamber 528 is defined by the first surface 512, the second surface 514, and a third surface 526.

In an aspect of this implementation, the modification logic 534 converts the spectral signal 550 to a modified spectral signal 566 by selectively modifying the amplitudes of the portions of the frequency spectrum of the spectral signal 550. A difference between the spectral signal 550 and the modified spectral signal 566 reflects the updated acoustic response of the device 500.

In accordance with this implementation, the modification logic 534 may provide the modified spectral signal 566 to the speakers **510*a*-510*b*. The speakers 510*a*-510*b* may vibrate in accordance with the modified spectral signal 566 to produce an acoustic representation of the modified spectral signal 566 in the resonance chamber 528**.

In an example embodiment, the resonance chamber has opposing first and second ends. For instance, the opposing first and second ends may be substantially perpendicular to the first surface, the second surface, and the third surface. In accordance with this embodiment, the device includes first speaker(s) and second speaker(s). The first speaker(s) are configured to steer at least a first portion of the spectral signal in a first direction toward the first end. The second speaker(s) are configured to steer at least a second portion of the spectral signal in a second direction toward the second end. For example, the first speaker(s) may include a first subset of the speakers **510*a*-510*b*, and the second speaker(s) may include a second subset of the speakers 510*a*-510*b*. In accordance with this example, the first subset of the speakers 510*a*-510*b* is configured to steer at least a first portion of the modified spectral signal 566 in the first direction toward the first end. In further accordance with this example, the second subset of the speakers 510*a*-510*b* is configured to steer at least a second portion of the modified spectral signal 566** in the second direction toward the second end.

In an aspect of this embodiment, the first speaker(s) include multiple first speakers, and the second speaker(s) include multiple second speakers. In accordance with this aspect, a first subset of the first speakers is configured to provide a first sound field from the first member (e.g., from the first surface of the first member), and a second subset of the first speakers is configured to provide a second sound field from the second member (e.g., from the second surface of the second member). In further accordance with this aspect, a first subset of the second speakers is configured to provide a third sound field from the first member (e.g., from the first surface of the first member), and a second subset of the second speakers is configured to provide a fourth sound field from the second member (e.g., from the second surface of the second member). In further accordance with this aspect, the first and second subsets of the first speakers are configured to cause interference between the first sound field and the second sound field to provide the first portion of the spectral signal. In further accordance with this aspect, the first and second subsets of the second speakers are configured to cause interference between the third sound field and the fourth sound field to provide the second portion of the spectral signal. Each of the first and second subsets of the first speakers and each of the first and second subsets of the second speakers may include at least one directional speaker, though the scope of the example embodiments is not limited in this respect.

The first speakers may be divided among the speakers 510*a*-510*b*, and the second speakers may be divided among the speakers 510*a*-510*b*. For example, the first speakers may include a first subset of the speakers 510*a* and a first subset of the speakers 510*b*. For instance, the first subset of the first speakers may include the first subset of the speakers 510*a*, and the second subset of the first speakers may include the first subset of the speakers 510*b*. In accordance with this example, the second speakers may include a second subset of the speakers 510*a* and a second subset of the speakers 510*b*. For instance, the first subset of the second speakers may include the second subset of the speakers 510*a*, and the second subset of the second speakers may include the second subset of the speakers 510*b*. Accordingly, the first subset of the speakers 510*a* may be configured to provide the first sound field from the first member 502. The first subset of the speakers 510*b* may be configured to provide the second sound field from the second member 504. The second subset of the speakers 510*a* may be configured to provide the third sound field from the first member 502. The second subset of the speakers 510*b* may be configured to provide the fourth sound field from the second member 504. In accordance with this example, the first subset of the speakers 510*a* and the first subset of the speakers 501*b* may be configured to cause interference between the first sound field and the second sound field to provide the first portion of the modified spectral signal 566. In further accordance with this example, the second subset of the speakers 510*a* and the second subset of the speakers 510*b* may be configured to cause interference between the third sound field and the fourth sound field to provide the second portion of the modified spectral signal 566. Each of the first speakers 510*a* and each of the second speakers 510*b* may be a directional speaker or an omni-directional speaker.

In another example embodiment, the first member includes a first screen region, and the second member includes a second screen region. In accordance with this embodiment, the first screen region has a first viewing surface, and the second screen region has a second viewing surface. A viewing surface is a surface of a screen region that is configured to be viewed (e.g., by a user of a device that includes the screen region). In an aspect of this embodiment, the first surface of the first member is the first viewing surface of the first screen region, and the second surface of the second member is the second viewing surface of the second screen region. In accordance with this aspect, the angle of the hinge is defined between the first viewing surface of the first screen region and the second viewing surface of the second screen region. In another aspect of this embodiment, the first surface of the first member and the first viewing surface of the first screen region are opposing surfaces of the first member. The second surface of the second member and the second viewing surface of the second screen region are opposing surfaces of the second member.

In some example embodiments, one or more steps 302 and/or 304 of flowchart 300 may not be performed. Moreover, steps in addition to or in lieu of steps 302 and/or 304 may be performed. For instance, in an example embodiment, the method of flowchart 300 further includes determining a shape of the resonance chamber based at least in part on the angle of the hinge, physical characteristic(s) of the first member, and physical characteristic(s) of the second member. The shape of the resonance chamber may include dimension(s) and/or volume of the resonance chamber. Examples of a dimension include but are not limited to length, width, and height. Examples of a physical characteristic include but are not limited to length, width, and shape. In accordance with this embodiment, selectively modifying the amplitudes of the respective portions of the frequency spectrum at step 304 may be based at least in part on the shape of the resonance chamber.

In an example implementation, the state logic 532 determines the shape of the resonance chamber 528 based at least in part on the hinge angle θ, physical characteristic(s) of the first member 502, and physical characteristic(s) of the second member 504. For example, the state logic 532 may review physical characteristic information 562 to determine the physical characteristic(s) of the first member 502 and the physical characteristic(s) of the second member 504. In accordance with this example, the physical characteristic information 562 may specify the physical characteristic(s) of the first member 502 and the physical characteristic(s) of the second member 504. In one aspect of this example, the store 530 may store the physical characteristic information 562. In accordance with this aspect, the state logic 532 may retrieve the physical characteristic information 562 from the store 530. In another aspect of this example, the sensor(s) 540 may generate the physical characteristic information 562 in response to sensing the physical characteristic(s) of the first member 502 and the physical characteristics of the second member 504.

In another example embodiment, the method of flowchart 300 further includes comparing the acoustic response to a reference acoustic response to determine a difference therebetween. In an example implementation, the determination logic 536 compares the acoustic response of the device 500 to a reference acoustic response 556 to determine a difference therebetween. For example, the sensor(s) 540 may sense the acoustic response of the device 500. In accordance with this example, the sensor(s) 540 may include microphone(s) to sense the acoustic response of the device 500. The sensor(s) 540 may generate acoustic response information 554 to indicate (e.g., specify) the acoustic response. The state logic 532 may provide the acoustic response information 554 to the determination logic 536 for analysis. The determination logic 536 may then compare the acoustic response, as indicated by the acoustic response information 554, and the reference acoustic response 556 to determine the difference therebetween. In accordance with this implementation, the determination logic 536 may generate difference information 560, which indicates the difference between the acoustic response and the reference acoustic response 556.

In accordance with this embodiment, selectively modifying the amplitudes of the respective portions of the frequency spectrum at step 304 may compensate for the difference between the acoustic response and the reference acoustic response. For example, the modification logic 534 may selectively modify the amplitudes of the respective portions of the frequency spectrum to compensate for the difference between the acoustic response and the reference acoustic response 556. In accordance with this example, the modification logic 534 may selectively modify the amplitudes in response to receipt of the difference information 560. For instance, the modification logic 534 may selectively modify the amplitudes based at least in part on the difference information 560 indicating the difference between the acoustic response and the reference acoustic response 556.

In an aspect of this embodiment, the reference acoustic response (e.g., reference acoustic response 536) is fixed and/or predetermined. For example, the store 530 may store the reference acoustic response 556. In accordance with this example, the determination logic 536 may retrieve the reference acoustic response 556 from the store 530.

In another aspect of this embodiment, the method of flowchart 300 further includes determining the reference acoustic response based at least in part on a test spectral signal that is provided in the resonance chamber by the device. In an example implementation, the determination logic 536 determines the reference acoustic response 556 based at least in part on the test spectral signal that is provided in the resonance chamber 528 by one or more of the first speaker(s) 510*a* and/or the second speaker(s) 510*b*.

In yet another example embodiment, the method of flowchart 300 further includes determining whether the hinge changes from a first state in which the angle of the hinge is greater than or equal to 180 degrees to a second state in which the angle of the hinge is less than 180 degrees. In an example implementation, the state logic 532 determines whether the hinge 506 changes from the first state in which the hinge angle θ is greater than or equal to 180 degrees to the second state in which the hinge angle θ is less than 180 degrees. In accordance with this implementation, the state logic 532 generates the state indicator 558 to indicate that the hinge 506 changes from the first state to the second state.

In accordance with this embodiment, the method of flowchart 300 further includes changing sound that is emitted by speakers at the first and second surfaces from stereophonic sound to monophonic sound based at least in part on a determination that the hinge changes from the first state to the second state. In an example implementation, the sound logic 538 changes the sound that is emitted by the speakers 510*a*-510*b* at the respective first and second surfaces 512 and 514 from stereophonic sound to monophonic sound based at least in part on a determination that the hinge 506 changes from the first state to the second state. For instance, the sound logic 538 may generate a sound instruction 552 in response to receipt of the state indicator 558 (e.g., based at least in part on the state indicator 558 indicating that the hinge 506 changes from the first state to the second state). In accordance with this example, the sound instruction 552 may instruct the modification logic 534 to configure the modified spectral signal 566 to have a monophonic format. In further accordance with this example, the modification logic 534 may configure the modified spectral signal 566 to have a single channel to create an impression that the resulting sounds that are produced by the speakers 510*a*-510*b* are being received from a single location.

In still another example embodiment, the method of flowchart 300 further includes determining that the hinge changes from a first state in which the angle of the hinge is less than 180 degrees to a second state in which the angle of the hinge is greater than or equal to 180 degrees. In an example implementation, the state logic 532 determines whether the hinge 506 changes from the first state in which the hinge angle θ is less than 180 degrees to the second state in which the hinge angle θ is greater than or equal to 180 degrees. In accordance with this implementation, the state logic 532 generates the state indicator 558 to indicate that the hinge 506 changes from the first state to the second state.

In accordance with this embodiment, the method of flowchart 300 further includes changing sound that is emitted by speakers at the first and second surfaces from monophonic sound to stereophonic sound based at least in part on a determination that the hinge changes from the first state to the second state. In an example implementation, the sound logic 538 changes the sound that is emitted by the speakers 510*a*-510*b* at the respective first and second surfaces 512 and 514 from monophonic sound to stereophonic sound based at least in part on a determination that the hinge 506 changes from the first state to the second state. For instance, the sound logic 538 may generate the sound instruction 552 in response to receipt of the state indicator 558 (e.g., based at least in part on the state indicator 558 indicating that the hinge 506 changes from the first state to the second state). In accordance with this example, the sound instruction 552 may instruct the modification logic 534 to configure the modified spectral signal 566 to have a stereophonic format. For instance, the modification logic 534 may configure the modified spectral signal 566 to have multiple channels to create an impression that the resulting sounds that are produced by the speakers 510*a*-510*b* are being received from various (e.g., different) directions.

In another example embodiment, the device includes first speaker(s) configured to provide a first version of the spectral signal and second speaker(s) configured to provide a second version of the spectral signal. For example, one or more of the speaker(s) 510*a* and one or more of the speaker(s) 510*b* (e.g., that are located proximate a first end of the resonance chamber 528) may be configured to provide a first version of the modified spectral signal 566. In accordance with this example, one or more of the speaker(s) 510*a* and one or more of the speaker(s) 510*b* (e.g., that are located proximate a second end of the resonance chamber 528) may be configured to provide a second version of the modified spectral signal 566. The first end of the resonance chamber 528 may be opposite the second end of the resonance chamber 528.

In accordance with this embodiment, the method of flowchart 300 further includes modifying a phase of the first version of the spectral signal and/or the second version of the spectral signal based at least in part on the angle of the hinge to cause the first and second versions of the spectral signal to be in-phase. In an example implementation, the phase logic 548 modifies a phase of a first version of the spectral signal 550 and/or a second version of the spectral signal 550 based at least in part on the hinge angle θ to cause the respective first and second versions of the modified spectral signal 566 to be in-phase.

In yet another example embodiment, selectively modifying the amplitudes of the respective portions of the frequency spectrum at step 304 of flowchart 300 may include one or more of the steps shown in flowchart 400 of FIG. 4. As shown in FIG. 4, the method of flowchart 400 begins at step 402. In step 402, selected frequencies in the acoustic response are caused to be boosted in the updated acoustic response. The selected frequencies may include one or more fundamental frequencies and/or harmonic(s) thereof. Accordingly, the selected frequencies may include one or more relatively low frequencies (e.g., bass frequencies), one or more relatively high frequencies (e.g., treble frequencies), one or more mid-range frequencies, or any combination thereof. In an example, one or more relatively low frequencies in the acoustic response are caused to be boosted in the updated acoustic response. For instance, the relatively low frequencies may include frequencies that are less than a threshold frequency. The threshold frequency may be approximately 300 Hz, 250 Hz, 200 Hz, or any other suitable value. In another example, harmonic(s) of at least one relatively low frequency in the acoustic response are caused to be boosted in the updated acoustic response. It will be recognized that based on the fundamental frequency, when the main frequency resides in the lower frequency spectrum (LFS), adding wide enhancements to the multiple harmonics of the main frequency may enable the sound of the low-frequency (LF) response of the device to be improved without overpowering the fundamental frequency and may enable undesired low-frequency issues to be mitigated (e.g., prevented). If a point is reached at which the low frequencies sound unclear, the low-frequency harmonics, rather than the fundamental frequency, may be enhanced (e.g., amplified).

In an example implementation, the boost logic 546 causes the selected frequencies in the acoustic response to be boosted in the updated acoustic response. In accordance with this implementation, the boost logic 546 may increase the amplitudes of the selected frequencies in the spectral signal 550 to provide the modified spectral signal 566. A difference between the spectral signal 550 and the modified spectral signal 566 may reflect the updated acoustic response.

At step 404, a standing wave frequency is identified based at least in part on the angle of the hinge. A standing wave frequency is a frequency on which a standing wave is based. For example, the identification logic 542 may identify a standing wave frequency based at least in part on the hinge angle θ. For instance, the store 530 may store a cross-reference map that cross-references hinge angles with respective standing wave frequencies. The identification logic 542 may review the cross-reference map to discover the hinge angle θ among the various hinge angles listed therein. The identification logic 524 may identify the standing wave frequency based on the hinge angle θ being cross-referenced with the standing wave frequency in the cross-reference map.

At step 406, the amplitude of the standing wave frequency is reduced in the frequency spectrum of the spectral signal. For instance, reducing the amplitude of the standing wave frequency may include causing a standing wave that is based on the standing wave frequency to be mitigated (e.g., eliminated) in the updated acoustic response. In an example, the reduction logic 544 may reduce the amplitude of the standing wave frequency in the frequency spectrum of the spectral signal to provide the modified spectral signal 566.

It will be recognized that the device 500 may not include one or more of the first member 502, the second member 504, the hinge 506, the angle-based update logic 508, the first speaker(s) 510*a*, the second speaker(s) 510*b*, the store 530, the state logic 532, the modification logic 534, the determination logic 536, the sound logic 538, the sensor(s) 540, the identification logic 542, the reduction logic 544, the boost logic 546, and/or the phase logic 548. Furthermore, the device 500 may include components in addition to or in lieu of the first member 502, the second member 504, the hinge 506, the angle-based update logic 508, the first speaker(s) 510*a*, the second speaker(s) 510*b*, the store 530, the state logic 532, the modification logic 534, the determination logic 536, the sound logic 538, the sensor(s) 540, the identification logic 542, the reduction logic 544, the boost logic 546, and/or the phase logic 548.

Figure 6:
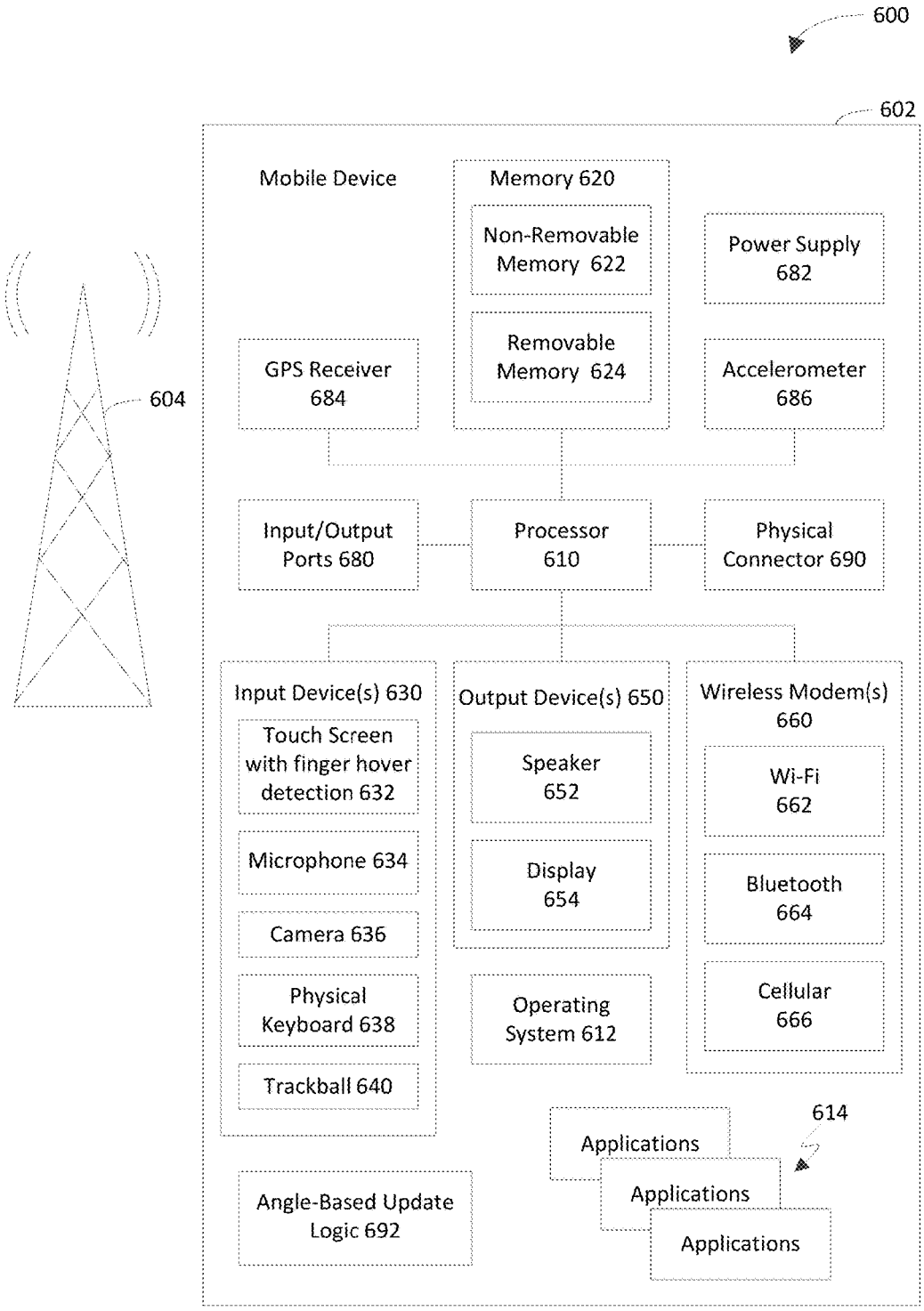
FIG. 6 is a system diagram of an exemplary mobile device in accordance with an embodiment.

FIG. 6 is a system diagram of an exemplary mobile device 600 including a variety of optional hardware and software components, shown generally as 602. Any components 602 in the mobile device may communicate with any other component, though not all connections are shown, for ease of illustration. The mobile device 600 may be any of a variety of computing devices (e.g., cell phone, smartphone, handheld computer, Personal Digital Assistant (PDA), etc.) and may allow wireless two-way communications with one or more mobile communications networks 604, such as a cellular or satellite network, or with a local area or wide area network.

The mobile device 600 may include a processor 610 (e.g., signal processor, microprocessor, ASIC, or other control and processing logic circuitry) for performing such tasks as signal coding, data processing, input/output processing, power control, and/or other functions. An operating system 612 may control the allocation and usage of the components 602 and support for one or more applications 614 (a.k.a. application programs). The applications 614 may include common mobile computing applications (e.g., email applications, calendars, contact managers, web browsers, messaging applications) and any other computing applications (e.g., word processing applications, mapping applications, media player applications).

The mobile device 600 may include memory 620. Memory 620 may include non-removable memory 622 and/or removable memory 624. The non-removable memory 622 may include RAM, ROM, flash memory, a hard disk, or other well-known memory storage technologies. The removable memory 624 may include flash memory or a Subscriber Identity Module (SIM) card, which is well known in GSM communication systems, or other well-known memory storage technologies, such as "smart cards." Memory 620 may store data and/or code for running the operating system 612 and the applications 614. Example data may include web pages, text, images, sound files, video data, or other data sets to be sent to and/or received from one or more network servers or other devices via one or more wired or wireless networks. Memory 620 may store a subscriber identifier, such as an International Mobile Subscriber Identity (IMSI), and an equipment identifier, such as an International Mobile Equipment Identifier (IMEI). Such identifiers may be transmitted to a network server to identify users and equipment.

The mobile device 600 may support one or more input devices 630, such as a touch screen 632, microphone 634, camera 636, physical keyboard 638 and/or trackball 640 and one or more output devices 650, such as a speaker 652 and a display 654. Touch screens, such as touch screen 632, may detect input in different ways. For example, capacitive touch screens detect touch input when an object (e.g., a fingertip) distorts or interrupts an electrical current running across the surface. As another example, touch screens may use optical sensors to detect touch input when beams from the optical sensors are interrupted. Physical contact with the surface of the screen is not necessary for input to be detected by some touch screens. For example, the touch screen 632 may support a finger hover detection using capacitive sensing, as is well understood in the art. Other detection techniques may be used, including camera-based detection and ultrasonic-based detection. To implement a finger hover, a user's finger is typically within a predetermined spaced distance above the touch screen, such as between 0.1 to 0.25 inches, or between 0.0.25 inches and 0.05 inches, or between 0.0.5 inches and 0.75 inches, or between 0.75 inches and 1 inch, or between 1 inch and 1.5 inches, etc.

The mobile device 600 may include angle-based update logic 692. The angle-based update logic 692 is configured to provide an updated acoustic response for the mobile device 600 based at least in part on a hinge angle in accordance with any one or more of the techniques described herein.

Other possible output devices (not shown) may include piezoelectric or other haptic output devices. Some devices may serve more than one input/output function. For example, touch screen 632 and display 654 may be combined in a single input/output device. The input devices 630 may include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 612 or applications 614 may include speech-recognition software as part of a voice control interface that allows a user to operate the device 600 via voice commands. Furthermore, the device 600 may include input devices and software that allows for user interaction via a user's spatial gestures, such as detecting and interpreting gestures to provide input to a gaming application.

Wireless modem(s) 660 may be coupled to antenna(s) (not shown) and may support two-way communications between the processor 610 and external devices, as is well understood in the art. The modem(s) 660 are shown generically and may include a cellular modem 666 for communicating with the mobile communication network 604 and/or other radio-based modems (e.g., Bluetooth 664 and/or Wi-Fi 662). At least one of the wireless modem(s) 660 is typically configured for communication with one or more cellular networks, such as a GSM network for data and voice communications within a single cellular network, between cellular networks, or between the mobile device and a public switched telephone network (PSTN).

The mobile device may further include at least one input/output port 680, a power supply 682, a satellite navigation system receiver 684, such as a Global Positioning System (GPS) receiver, an accelerometer 686, and/or a physical connector 690, which may be a USB port, IEEE 1394 (FireWire) port, and/or RS-232 port. The illustrated components 602 are not required or all-inclusive, as any components may be deleted and other components may be added as would be recognized by one skilled in the art.

Although the operations of some of the disclosed methods are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods may be used in conjunction with other methods.

Any one or more of the angle-based update logic 108, the angle-based update logic 208, the angle-based update logic 508, the state logic 532, the modification logic 534, the determination logic 536, the sound logic 538, the identification logic 542, the reduction logic 544, the boost logic 546, the phase logic 548, flowchart 300, and/or flowchart 400 may be implemented in hardware, software, firmware, or any combination thereof.

For example, any one or more of the angle-based update logic 108, the angle-based update logic 208, the angle-based update logic 508, the state logic 532, the modification logic 534, the determination logic 536, the sound logic 538, the identification logic 542, the reduction logic 544, the boost logic 546, the phase logic 548, flowchart 300, and/or flowchart 400 may be implemented as computer program code configured to be executed in one or more processors.

In another example, any one or more of the angle-based update logic 108, the angle-based update logic 208, the angle-based update logic 508, the state logic 532, the modification logic 534, the determination logic 536, the sound logic 538, the identification logic 542, the reduction logic 544, the boost logic 546, the phase logic 548, flowchart 300, and/or flowchart 400 may be implemented as hardware logic/electrical circuitry.

For instance, in an embodiment, one or more of the angle-based update logic 108, the angle-based update logic 208, the angle-based update logic 508, the state logic 532, the modification logic 534, the determination logic 536, the sound logic 538, the identification logic 542, the reduction logic 544, the boost logic 546, the phase logic 548, flowchart 300, and/or flowchart 400 may be implemented in a system-on-chip (SoC). The SoC may include an integrated circuit chip that includes one or more of a processor (e.g., a microcontroller, microprocessor, digital signal processor (DSP), etc.), memory, one or more communication interfaces, and/or further circuits and/or embedded firmware to perform its functions.

III. Example Computer System

Figure 7:
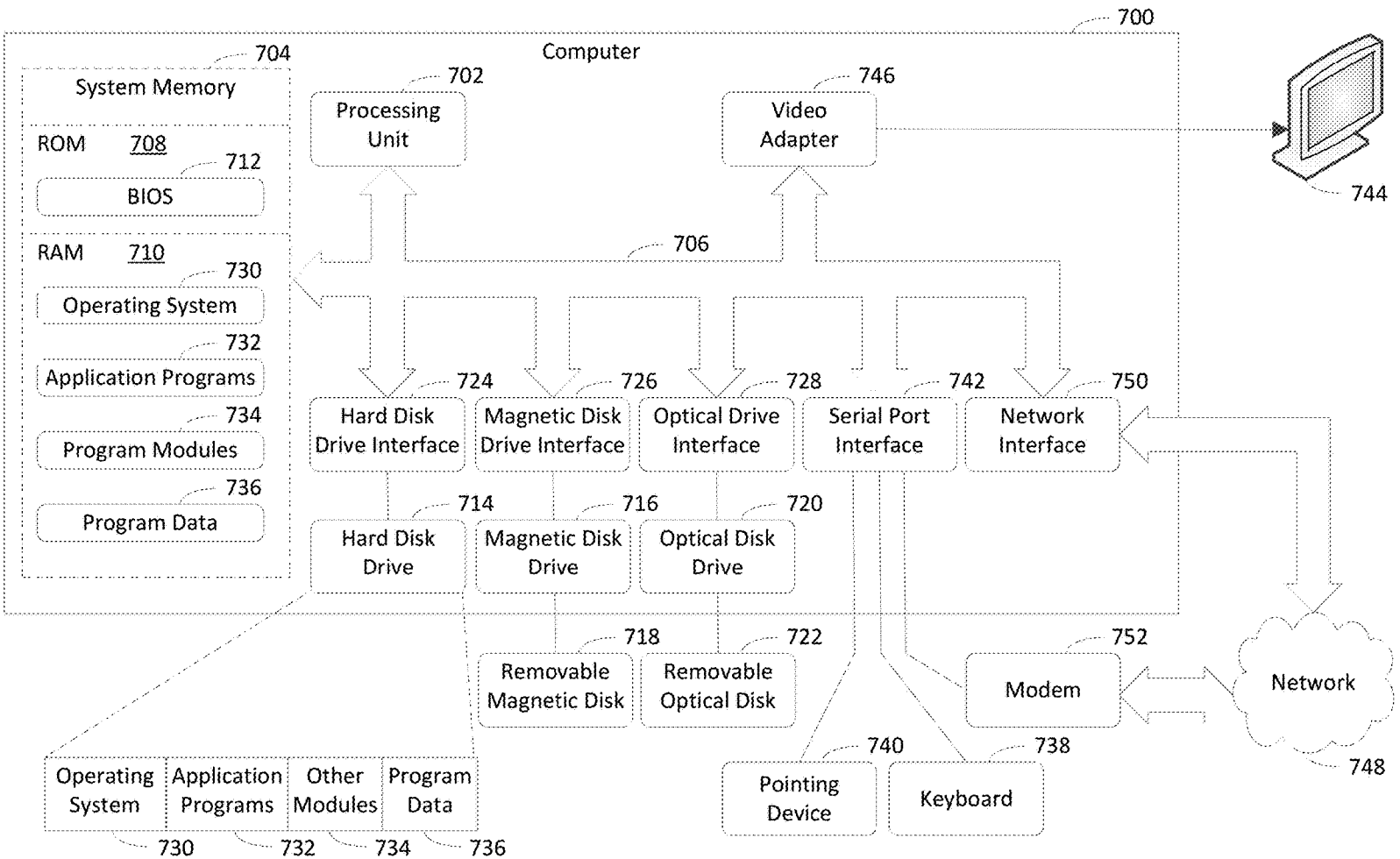
FIG. 7 depicts an example computer in which embodiments may be implemented.

FIG. 7 depicts an example computer 700 in which embodiments may be implemented. For instance, any one or more of devices 100, 200, and 500 shown in respective FIGS. 1-2 and 5 and/or mobile device 600 shown in FIG. 6 may be implemented using computer 700, including one or more features of computer 700 and/or alternative features. Computer 700 may be a general-purpose computing device in the form of a conventional personal computer, a mobile computer, or a workstation, for example, or computer 700 may be a special purpose computing device. The description of computer 700 provided herein is provided for purposes of illustration, and is not intended to be limiting. Embodiments may be implemented in further types of computer systems, as would be known to persons skilled in the relevant art(s).

As shown in FIG. 7, computer 700 includes a processing unit 702, a system memory 704, and a bus 706 that couples various system components including system memory 704 to processing unit 702. Bus 706 represents one or more of any of several types of bus structures, including a memory bus or memory controller, a peripheral bus, an accelerated graphics port, and a processor or local bus using any of a variety of bus architectures. System memory 704 includes read only memory (ROM) 708 and random access memory (RAM) 710. A basic input/output system 712 (BIOS) is stored in ROM 708.

Computer 700 also has one or more of the following drives: a hard disk drive 714 for reading from and writing to a hard disk, a magnetic disk drive 716 for reading from or writing to a removable magnetic disk 718, and an optical disk drive 720 for reading from or writing to a removable optical disk 722 such as a CD ROM, DVD ROM, or other optical media. Hard disk drive 714, magnetic disk drive 716, and optical disk drive 720 are connected to bus 706 by a hard disk drive interface 724, a magnetic disk drive interface 726, and an optical drive interface 728, respectively. The drives and their associated computer-readable storage media provide nonvolatile storage of computer-readable instructions, data structures, program modules and other data for the computer. Although a hard disk, a removable magnetic disk and a removable optical disk are described, other types of computer-readable storage media can be used to store data, such as flash memory cards, digital video disks, random access memories (RAMs), read only memories (ROM), and the like.

A number of program modules may be stored on the hard disk, magnetic disk, optical disk, ROM, or RAM. These programs include an operating system 730, one or more application programs 732, other program modules 734, and program data 736. Application programs 732 or program modules 734 may include, for example, computer program logic for implementing any one or more of the angle-based update logic 108, the angle-based update logic 208, the angle-based update logic 508, the state logic 532, the modification logic 534, the determination logic 536, the sound logic 538, the identification logic 542, the reduction logic 544, the boost logic 546, the phase logic 548, flowchart 300 (including any step of flowchart 300), and/or flowchart 400 (including any step of flowchart 400), as described herein.

A user may enter commands and information into the computer 700 through input devices such as keyboard 738 and pointing device 740. Other input devices (not shown) may include a microphone, joystick, game pad, satellite dish, scanner, touch screen, camera, accelerometer, gyroscope, or the like. These and other input devices are often connected to the processing unit 702 through a serial port interface 742 that is coupled to bus 706, but may be connected by other interfaces, such as a parallel port, game port, or a universal serial bus (USB).

A display device 744 (e.g., a monitor) is also connected to bus 706 via an interface, such as a video adapter 746. In addition to display device 744, computer 700 may include other peripheral output devices (not shown) such as speakers and printers.

Computer 700 is connected to a network 748 (e.g., the Internet) through a network interface or adapter 750, a modem 752, or other means for establishing communications over the network. Modem 752, which may be internal or external, is connected to bus 706 via serial port interface 742.

As used herein, the terms "computer program medium" and "computer-readable storage medium" are used to generally refer to media (e.g., non-transitory media) such as the hard disk associated with hard disk drive 714, removable magnetic disk 718, removable optical disk 722, as well as other media such as flash memory cards, digital video disks, random access memories (RAMs), read only memories (ROM), and the like. Such computer-readable storage media are distinguished from and non-overlapping with communication media (do not include communication media). Communication media embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, RF, infrared and other wireless media, as well as wired media. Example embodiments are also directed to such communication media.

As noted above, computer programs and modules (including application programs 732 and other program modules 734) may be stored on the hard disk, magnetic disk, optical disk, ROM, or RAM. Such computer programs may also be received via network interface 750 or serial port interface 742. Such computer programs, when executed or loaded by an application, enable computer 700 to implement features of embodiments discussed herein. Accordingly, such computer programs represent controllers of the computer 700.

Example embodiments are also directed to computer program products comprising software (e.g., computer-readable instructions) stored on any computer-useable medium. Such software, when executed in one or more data processing devices, causes data processing device(s) to operate as described herein. Embodiments may employ any computer-useable or computer-readable medium, known now or in the future. Examples of computer-readable mediums include, but are not limited to storage devices such as RAM, hard drives, floppy disks, CD ROMs, DVD ROMs, zip disks, tapes, magnetic storage devices, optical storage devices, MEMS-based storage devices, nanotechnology-based storage devices, and the like.

It will be recognized that the disclosed technologies are not limited to any particular computer or type of hardware. Certain details of suitable computers and hardware are well known and need not be set forth in detail in this disclosure.

IV. Further Discussion of Some Example Embodiments

An example device comprises a hinge coupled between a first member and a second member. The hinge forms an angle between a first surface of the first member and a second surface of the second member. The example device further comprises one or more speakers configured to provide a spectral signal in a resonance chamber that is defined by the first surface, the second surface, and a third surface. The example device further comprises modification logic configured to selectively modify an amplitude of each of a plurality of portions of a frequency spectrum of the spectral signal to change an acoustic response of the device that is associated with the resonance chamber to an updated acoustic response based at least in part on the angle of the hinge.

In a first aspect of the example device, the example device further comprises state logic configured to determine a shape of the resonance chamber based at least in part on the angle of the hinge, one or more physical characteristics of the first member, and one or more physical characteristics of the second member. In accordance with the first aspect, the modification logic is configured to selectively modify the amplitude of each of the plurality of portions of the frequency spectrum based at least in part on the shape of the resonance chamber.

In a second aspect of the example device, the example device further comprises determination logic configured to compare the acoustic response to a reference acoustic response to determine a difference therebetween. In accordance with the second aspect, the modification logic is configured to selectively modify the amplitude of each of the plurality of portions of the frequency spectrum to compensate for the difference between the acoustic response and the reference acoustic response. The second aspect of the example device may be implemented in combination with the first aspect of the example device, though the example embodiments are not limited in this respect.

In an implementation of the second aspect of the example device, the determination logic is configured to determine the reference acoustic response based at least in part on a test spectral signal that is provided in the resonance chamber by at least one of the one or more speakers.

In a third aspect of the example device, the modification logic is configured to cause selected frequencies in the acoustic response to be boosted in the updated acoustic response by selectively modifying the amplitude of each of the plurality of portions of the frequency spectrum. The third aspect of the example device may be implemented in combination with the first and/or second aspect of the example device, though the example embodiments are not limited in this respect.

In a fourth aspect of the example device, the modification logic comprises identification logic configured to identify a standing wave frequency based at least in part on the angle of the hinge. In accordance with the fourth aspect, the modification logic further comprises reduction logic configured to reduce the amplitude of the standing wave frequency in the frequency spectrum of the spectral signal in response to identification of the standing wave frequency. The fourth aspect of the example device may be implemented in combination with the first, second, and/or third aspect of the example device, though the example embodiments are not limited in this respect.

In a fifth aspect of the example device, the example device further comprises state logic configured to determine whether the hinge changes from a first state in which the angle of the hinge is greater than or equal to 180 degrees to a second state in which the angle of the hinge is less than 180 degrees. In accordance with the fifth aspect, the example device further comprises sound logic configured to change sound that is emitted by a first subset of the one or more speakers at the first surface and a second subset of the one or more speakers at the second surface from stereophonic sound to monophonic sound based at least in part on a determination that the hinge changes from the first state to the second state. The fifth aspect of the example device may be implemented in combination with the first, second, third, and/or fourth aspect of the example device, though the example embodiments are not limited in this respect.

In a sixth aspect of the example device, the example device further comprises state logic configured to determine whether the hinge changes from a first state in which the angle of the hinge is less than 180 degrees to a second state in which the angle of the hinge is greater than or equal to 180 degrees. In accordance with the sixth aspect, the example device further comprises sound logic configured to change sound that is emitted by a first subset of the one or more speakers at the first surface and a second subset of the one or more speakers at the second surface from monophonic sound to stereophonic sound based at least in part on a determination that the hinge changes from the first state to the second state. The sixth aspect of the example device may be implemented in combination with the first, second, third, fourth, and/or fifth aspect of the example device, though the example embodiments are not limited in this respect.

In a seventh aspect of the example device, the resonance chamber has opposing first and second ends. In accordance with the seventh aspect, the one or more speakers comprise one or more first speakers configured to steer at least a first portion of the spectral signal in a first direction toward the first end. In further accordance with the seventh aspect, the one or more speakers further comprise one or more second speakers configured to steer at least a second portion of the spectral signal in a second direction toward the second end. The seventh aspect of the example device may be implemented in combination with the first, second, third, fourth, fifth, and/or sixth aspect of the example device, though the example embodiments are not limited in this respect.

In an implementation of the seventh aspect of the example device, the one or more first speakers include multiple first speakers, and the one or more second speakers include multiple second speakers. In accordance with the seventh aspect, a first subset of the first speakers is configured to provide a first sound field from the first member. In further accordance with this implementation, a second subset of the first speakers is configured to provide a second sound field from the second member. In further accordance with this implementation, a first subset of the second speakers is configured to provide a third sound field from the first member. In further accordance with this implementation, a second subset of the second speakers is configured to provide a fourth sound field from the second member. In further accordance with this implementation, the first and second subsets of the first speakers are configured to cause interference between the first sound field and the second sound field to provide the first portion of the spectral signal. In further accordance with this implementation, the first and second subsets of the second speakers are configured to cause interference between the third sound field and the fourth sound field to provide the second portion of the spectral signal.

In an eighth aspect of the example device, the one or more speakers comprise one or more first speakers configured to provide a first version of the spectral signal. In accordance with the eighth aspect, the one or more speakers further comprise one or more second speakers configured to provide a second version of the spectral signal. In further accordance with the eighth aspect, the modification logic is configured to modify a phase of at least one of the first version of the spectral signal or the second version of the spectral signal based at least in part on the angle of the hinge to cause the first and second versions of the spectral signal to be in-phase. The eighth aspect of the example device may be implemented in combination with the first, second, third, fourth, fifth, sixth, and/or seventh aspect of the example device, though the example embodiments are not limited in this respect.

In a ninth aspect of the example device, the first member includes a first screen region having a first viewing surface. In accordance with the ninth aspect, the second member includes a second screen region having a second viewing surface. In further accordance with the ninth aspect, the first surface of the first member and the first viewing surface are same. In further accordance with the ninth aspect, the second surface of the second member and the second viewing surface are same. The ninth aspect of the example device may be implemented in combination with the first, second, third, fourth, fifth, sixth, seventh, and/or eighth aspect of the example device, though the example embodiments are not limited in this respect.

In a tenth aspect of the example device, the first member includes a first screen region. In accordance with the tenth aspect, the second member includes a second screen region. In further accordance with the tenth aspect, the first surface is opposite a first viewing surface of the first screen region. In further accordance with the tenth aspect, the second surface is opposite a second viewing surface of the second screen region. The tenth aspect of the example device may be implemented in combination with the first, second, third, fourth, fifth, sixth, seventh, and/or eighth aspect of the example device, though the example embodiments are not limited in this respect.

In an example method, an angle of a hinge that is coupled between first and second members of a device is determined. The angle of the hinge is defined between a first surface of the first member and a second surface of the second member. An amplitude of each of a plurality of portions of a frequency spectrum of a spectral signal is selectively modified to change an acoustic response of the device that is associated with a resonance chamber to an updated acoustic response based at least in part on the angle of the hinge. The resonance chamber is defined by the first surface, the second surface, and a third surface.

In a first aspect of the example method, the example method further comprises determining a shape of the resonance chamber based at least in part on the angle of the hinge, one or more physical characteristics of the first member, and one or more physical characteristics of the second member. In accordance with the first aspect, selectively modifying the amplitude of each of the plurality of portions of the frequency spectrum is based at least in part on the shape of the resonance chamber.

In a second aspect of the example method, the example method further comprises comparing the acoustic response to a reference acoustic response to determine a difference therebetween. In accordance with the second aspect, selectively modifying the amplitude of each of the plurality of portions of the frequency spectrum compensates for the difference between the acoustic response and the reference acoustic response. The second aspect of the example method may be implemented in combination with the first aspect of the example method, though the example embodiments are not limited in this respect.

In an implementation of the second aspect of the example method, the example method further comprises determining the reference acoustic response based at least in part on a test spectral signal that is provided in the resonance chamber by the device.

In a third aspect of the example method, selectively modifying the amplitude of each of the plurality of portions of the frequency spectrum causes selected frequencies in the acoustic response to be boosted in the updated acoustic response. The third aspect of the example method may be implemented in combination with the first and/or second aspect of the example method, though the example embodiments are not limited in this respect.

In a fourth aspect of the example method, selectively modifying the amplitude of each of the plurality of portions of the frequency spectrum comprises identifying a standing wave frequency based at least in part on the angle of the hinge. In accordance with the fourth aspect, selectively modifying the amplitude of each of the plurality of portions of the frequency spectrum further comprises reducing the amplitude of the standing wave frequency in the frequency spectrum of the spectral signal in response to identifying the standing wave frequency. The fourth aspect of the example method may be implemented in combination with the first, second, and/or third aspect of the example method, though the example embodiments are not limited in this respect.

In a fifth aspect of the example method, the example method further comprises determining that the hinge changes from a first state in which the angle of the hinge is greater than or equal to 180 degrees to a second state in which the angle of the hinge is less than 180 degrees. In accordance with the fifth aspect, the example method further comprises changing sound that is emitted by speakers at the first and second surfaces from stereophonic sound to monophonic sound based at least in part on a determination that the hinge changes from the first state to the second state. The fifth aspect of the example method may be implemented in combination with the first, second, third, and/or fourth aspect of the example method, though the example embodiments are not limited in this respect.

In a sixth aspect of the example method, the example method further comprises determining that the hinge changes from a first state in which the angle of the hinge is less than 180 degrees to a second state in which the angle of the hinge is greater than or equal to 180 degrees. In accordance with the sixth aspect, the example method further comprises changing sound that is emitted by speakers at the first and second surfaces from monophonic sound to stereophonic sound based at least in part on a determination that the hinge changes from the first state to the second state. The sixth aspect of the example method may be implemented in combination with the first, second, third, fourth, and/or fifth aspect of the example method, though the example embodiments are not limited in this respect.

In a seventh aspect of the example method, the resonance chamber has opposing first and second ends. In accordance with the seventh aspect, the device includes one or more first speakers and one or more second speakers. In further accordance with the seventh aspect, the one or more first speakers are configured to steer at least a first portion of the spectral signal in a first direction toward the first end. In further accordance with the seventh aspect, the one or more second speakers are configured to steer at least a second portion of the spectral signal in a second direction toward the second end. The seventh aspect of the example method may be implemented in combination with the first, second, third, fourth, fifth, and/or sixth aspect of the example method, though the example embodiments are not limited in this respect.

In an implementation of the seventh aspect of the example method, the one or more first speakers include multiple first speakers, and the one or more second speakers include multiple second speakers. In accordance with the seventh aspect, a first subset of the first speakers is configured to provide a first sound field from the first member. In further accordance with this implementation, a second subset of the first speakers is configured to provide a second sound field from the second member. In further accordance with this implementation, a first subset of the second speakers is configured to provide a third sound field from the first member. In further accordance with this implementation, a second subset of the second speakers is configured to provide a fourth sound field from the second member. In further accordance with this implementation, the first and second subsets of the first speakers are configured to cause interference between the first sound field and the second sound field to provide the first portion of the spectral signal. In further accordance with this implementation, the first and second subsets of the second speakers are configured to cause interference between the third sound field and the fourth sound field to provide the second portion of the spectral signal.

In an eighth aspect of the example method, the device includes one or more first speakers configured to provide a first version of the spectral signal and one or more second speakers configured to provide a second version of the spectral signal. In accordance with the eighth aspect, the method further comprises modifying a phase of at least one of the first version of the spectral signal or the second version of the spectral signal based at least in part on the angle of the hinge to cause the first and second versions of the spectral signal to be in-phase. The eighth aspect of the example method may be implemented in combination with the first, second, third, fourth, fifth, sixth, and/or seventh aspect of the example method, though the example embodiments are not limited in this respect.

In a ninth aspect of the example method, the first surface of the first member and a first viewing surface of a first screen region that is included in the first member are same. In accordance with the ninth aspect, the second surface of the second member and a second viewing surface of a second screen region that is included in the second member are same. The ninth aspect of the example method may be implemented in combination with the first, second, third, fourth, fifth, sixth, seventh, and/or eighth aspect of the example method, though the example embodiments are not limited in this respect.

In a tenth aspect of the example method, the first surface is opposite a first viewing surface of a first screen region that is included in the first member. In accordance with the tenth aspect, the second surface is opposite a second viewing surface of a second screen region that is included in the second member. The tenth aspect of the example method may be implemented in combination with the first, second, third, fourth, fifth, sixth, seventh, and/or eighth aspect of the example method, though the example embodiments are not limited in this respect.

An example computer program product comprises a computer-readable storage medium having instructions recorded thereon for enabling a processor-based system to change an acoustic response of a device based at least in part on an angle of a hinge. The instructions comprise first instructions for enabling the processor-based system to determine the angle of the hinge that is coupled between first and second members of the device. The angle of the hinge is defined between a first surface of the first member and a second surface of the second member. The instructions further comprise second instructions for enabling the processor-based system to selectively modify an amplitude of each of a plurality of portions of a frequency spectrum of a spectral signal to change the acoustic response of the device that is associated with a resonance chamber to an updated acoustic response based at least in part on the angle of the hinge. The resonance chamber is defined by the first surface, the second surface, and a third surface.

V. Conclusion

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

What is claimed is:

1. A device comprising:

a hinge coupled between a first member and a second member, the hinge forming an angle between a first surface of the first member and a second surface of the second member;

one or more speakers configured to provide a spectral signal in a resonance chamber that is defined by the first surface, the second surface, and a third surface; and modification logic configured to selectively modify an amplitude of each of a plurality of portions of a frequency spectrum of the spectral signal to change an acoustic response of the device that is associated with the resonance chamber to an updated acoustic response based at least in part on the angle of the hinge.

2. The device of claim 1, further comprising:

state logic configured to determine a shape of the resonance chamber based at least in part on the angle of the hinge, one or more physical characteristics of the first member, and one or more physical characteristics of the second member;

wherein the modification logic is configured to selectively modify the amplitude of each of the plurality of portions of the frequency spectrum based at least in part on the shape of the resonance chamber.

3. The device of claim 1, further comprising:

determination logic configured to compare the acoustic response to a reference acoustic response to determine a difference therebetween;

wherein the modification logic is configured to selectively modify the amplitude of each of the plurality of portions of the frequency spectrum to compensate for the difference between the acoustic response and the reference acoustic response.

4. The device of claim 3, wherein the determination logic is configured to determine the reference acoustic response based at least in part on a test spectral signal that is provided in the resonance chamber by at least one of the one or more speakers.

5. The device of claim 1, wherein the modification logic is configured to cause selected frequencies in the acoustic response to be boosted in the updated acoustic response by selectively modifying the amplitude of each of the plurality of portions of the frequency spectrum.

6. The device of claim 1, wherein the modification logic comprises:

identification logic configured to identify a standing wave frequency based at least in part on the angle of the hinge; and reduction logic configured to reduce the amplitude of the standing wave frequency in the frequency spectrum of the spectral signal in response to identification of the standing wave frequency.

7. The device of claim 1, further comprising:

state logic configured to determine whether the hinge changes from a first state in which the angle of the hinge is greater than or equal to 180 degrees to a second state in which the angle of the hinge is less than 180 degrees; and sound logic configured to change sound that is emitted by a first subset of the one or more speakers at the first surface and a second subset of the one or more speakers at the second surface from stereophonic sound to monophonic sound based at least in part on a determination that the hinge changes from the first state to the second state.

8. The device of claim 1, further comprising:

state logic configured to determine whether the hinge changes from a first state in which the angle of the hinge is less than 180 degrees to a second state in which the angle of the hinge is greater than or equal to 180 degrees; and sound logic configured to change sound that is emitted by a first subset of the one or more speakers at the first surface and a second subset of the one or more speakers at the second surface from monophonic sound to stereophonic sound based at least in part on a determination that the hinge changes from the first state to the second state.

9. The device of claim 1, wherein the resonance chamber has opposing first and second ends; and wherein the one or more speakers comprise:

one or more first speakers configured to steer at least a first portion of the spectral signal in a first direction toward the first end; and one or more second speakers configured to steer at least a second portion of the spectral signal in a second direction toward the second end.

10. The device of claim 9, wherein the one or more first speakers include multiple first speakers;

wherein the one or more second speakers include multiple second speakers;

wherein a first subset of the first speakers is configured to provide a first sound field from the first member;

wherein a second subset of the first speakers is configured to provide a second sound field from the second member;

wherein a first subset of the second speakers is configured to provide a third sound field from the first member;

wherein a second subset of the second speakers is configured to provide a fourth sound field from the second member;

wherein the first and second subsets of the first speakers are configured to cause interference between the first sound field and the second sound field to provide the first portion of the spectral signal; and wherein the first and second subsets of the second speakers are configured to cause interference between the third sound field and the fourth sound field to provide the second portion of the spectral signal.

11. The device of claim 1, wherein the one or more speakers comprise:

one or more first speakers configured to provide a first version of the spectral signal; and one or more second speakers configured to provide a second version of the spectral signal; and wherein the modification logic is configured to modify a phase of at least one of the first version of the spectral signal or the second version of the spectral signal based at least in part on the angle of the hinge to cause the first and second versions of the spectral signal to be in-phase.

12. The device of claim 1, wherein the first member includes a first screen region having a first viewing surface;

wherein the second member includes a second screen region having a second viewing surface; and wherein the first surface of the first member and the first viewing surface are same; and wherein the second surface of the second member and the second viewing surface are same.

13. The device of claim 1, wherein the first member includes a first screen region;

wherein the second member includes a second screen region;

wherein the first surface is opposite a first viewing surface of the first screen region; and wherein the second surface is opposite a second viewing surface of the second screen region.

14. A method comprising:

determining an angle of a hinge that is coupled between first and second members of a device, the angle of the hinge defined between a first surface of the first member and a second surface of the second member; and selectively modifying an amplitude of each of a plurality of portions of a frequency spectrum of a spectral signal to change an acoustic response of the device that is associated with a resonance chamber to an updated acoustic response based at least in part on the angle of the hinge, the resonance chamber defined by the first surface, the second surface, and a third surface.

15. The method of claim 14, further comprising:

determining a shape of the resonance chamber based at least in part on the angle of the hinge, one or more physical characteristics of the first member, and one or more physical characteristics of the second member;

wherein selectively modifying the amplitude of each of the plurality of portions of the frequency spectrum is based at least in part on the shape of the resonance chamber.

16. The method of claim 14, further comprising:

comparing the acoustic response to a reference acoustic response to determine a difference therebetween;

wherein selectively modifying the amplitude of each of the plurality of portions of the frequency spectrum compensates for the difference between the acoustic response and the reference acoustic response.

17. The method of claim 14, wherein selectively modifying the amplitude of each of the plurality of portions of the frequency spectrum causes selected frequencies in the acoustic response to be boosted in the updated acoustic response.

18. The method of claim 14, wherein selectively modifying the amplitude of each of the plurality of portions of the frequency spectrum comprises:

identifying a standing wave frequency based at least in part on the angle of the hinge; and reducing the amplitude of the standing wave frequency in the frequency spectrum of the spectral signal in response to identifying the standing wave frequency.

19. The method of claim 14, further comprising:

determining that the hinge changes from a first state in which the angle of the hinge is greater than or equal to 180 degrees to a second state in which the angle of the hinge is less than 180 degrees; and changing sound that is emitted by speakers at the first and second surfaces from stereophonic sound to monophonic sound based at least in part on a determination that the hinge changes from the first state to the second state.

20. A computer program product comprising a computer-readable storage medium having instructions recorded thereon for enabling a processor-based system to change an acoustic response of a device based at least in part on an angle of a hinge, the instructions comprising:

first instructions for enabling the processor-based system to determine the angle of the hinge that is coupled between first and second members of the device, the angle of the hinge defined between a first surface of the first member and a second surface of the second member; and second instructions for enabling the processor-based system to selectively modify an amplitude of each of a plurality of portions of a frequency spectrum of a spectral signal to change the acoustic response of the device that is associated with a resonance chamber to an updated acoustic response based at least in part on the angle of the hinge, the resonance chamber defined by the first surface, the second surface, and a third surface.

* * * * *